US006015304A

United States Patent [19]

Yagi et al.

[11] Patent Number: 6,015,304

[45] Date of Patent: Jan. 18, 2000

[54] GROUND-ENHANCED ELECTRICAL CONNECTOR

[75] Inventors: Masanori Yagi, Ebina; Atsuhito Noda, Hachioji; Yasuhiro Ichijo; Hideyuki Hirata, both of Yokohama, all of Japan

[73] Assignee: Molex Incorporated, Lisle, Ill.

[21] Appl. No.: 09/091,980

[22] PCT Filed: Dec. 23, 1996

[86] PCT No.: PCT/US96/20250

§ 371 Date: Jul. 27, 1998

§ 102(e) Date: Jul. 27, 1998

[87] PCT Pub. No.: WO97/24782

PCT Pub. Date: Jul. 10, 1997

[30] Foreign Application Priority Data

Dec. 29, 1995 [JP] Japan ..... 7-353375

[51] Int. Cl.[7] ..... H01R 13/648

[52] U.S. Cl. ..... 439/108; 439/607

[58] Field of Search ..... 439/108, 607, 439/638, 101, 92, 79, 69, 608, 609, 610

[56] References Cited

U.S. PATENT DOCUMENTS

| | | | |
|---|---|---|---|
| 3,587,029 | 6/1971 | Knowles | 439/108 |
| 4,718,867 | 1/1988 | Seidel et al. | 439/609 |
| 5,030,140 | 7/1991 | Sugiyama | 439/607 |
| 5,047,041 | 9/1991 | Yu | 439/620 |
| 5,174,771 | 12/1992 | Burgit | 439/108 |
| 5,591,050 | 1/1997 | Sueoka | 439/607 |
| 5,813,871 | 9/1998 | Grabbe et al. | 439/108 |
| 5,876,247 | 3/1999 | Hashimoto | 439/607 |

FOREIGN PATENT DOCUMENTS

| | | |
|---|---|---|
| WO96/24969 | 8/1996 | WIPO . |
| WO97/32366 | 9/1997 | WIPO . |

*Primary Examiner*—Paula Bradley
*Assistant Examiner*—Alexander Gilman
*Attorney, Agent, or Firm*—Charles S. Cohen

[57] ABSTRACT

An electrical connector with enhanced grounding characteristics which reduce the possibility of signal transmission error includes a connector housing formed from an electrically insulative material, a plurality of conductive terminals mounted on the connector housing, the terminals having tail portions which extend out of and away from the connector housing for attachment to a printed circuit board. A conductive grounding plate, in the form of a metal shield, is mounted to the exterior of the connector housing The grounding plate incudes at least one grounding terminal integrally formed therewith at extending outwardly therefrom at the level of the connector conductive terminals in a space between two adjoining conductive terminals.

24 Claims, 6 Drawing Sheets

GROUND-ENHANCED ELECTRICAL CONNECTOR

BACKGROUND OF THE INVENTION

The present invention relates generally to electrical connectors for effecting reliable connections between printed circuits, and more specifically, to electrical connectors having enhanced grounding characteristics which increase the suitability of the connectors for use in high speed and high-frequency signal applications.

When an electrical connector is used to connect together high-frequency signal circuits of printed circuit boards, or a printed circuit board and a conductive wire together, a metal grounding plate is utilized as part of the connector to prevent external leakage of the high-frequency circuits at the connector. The grounding plate is located on the exterior on the insulated housing of the connector as described in Japanese Unexamined Patent Publication No. 5-217630 and Japanese Unexamined Patent Publication No. 6-84568, for example. These type connectors utilize an insulative housing, a plurality of terminals mounted within the insulative housing and a conductive metal grounding plate attached to the exterior of the insulative housing. A cross-sectional view of these connectors would reveal, in essence, a "sandwich" type structure where the insulative housing is held, or sandwiched, between the connector terminals and the grounding plate. In such a construction, the terminals tend to act as capacitors and when a high-frequency signal is applied to a particular terminal, that signal may tend to "jump" through or across the insulative housing as well as any adjacent air gap to the metal grounding plate. This phenomenon is commonly referred to in the art as capacitive coupling. The grounding plate is connected at opposite ends of the connector to grounding circuits so that any signals which are coupled to the grounding plate will pass to a groundpath and not pass to any other terminals in the connector.

However, when the high-frequency signals jump to the grounding plate and seek the grounding circuits connected thereto at the ends of the connector, the possibility exists, especially when the length of the connector is increased, that the high-frequency signal may radiate as it travels the length of the connector to the ground circuits thereat. This is known as an "antenna effect" because the grounding plate acts as an antenna and the high-frequency signals may jump or be coupled back to other terminals of the connector, resulting in mistransmission and signal error that is detrimental to the operation of the circuits and of the connector.

In the aforementioned connectors, grounding terminals are integrally formed with the grounding plate and are located at opposite ends of the connector in the longitudinal directions, so as not interfere with the solder tail portions of the connector terminals. As the length of the connector is increased, the number of terminals are also increased and the length of the antenna locally formed in the grounding plate as explained above also increases, which in turn, increases the possibility of erroneous transmission of high frequency signals to other terminals of the connector.

SUMMARY OF THE INVENTION

The present invention provides a solution to the problems set forth above. It is an object of the present invention to provide an electrical connector with enhanced grounding capability in the grounding plate that reduces the likelihood of detrimental leakage of high-frequency signals from occurring.

In order to accomplish this and other objects, an enhanced grounding connector constructed in accordance with one aspect of the present invention, comprises an insulative housing, a plurality of terminals mounted within the insulative housing, the terminals having solder tail portions of the terminals extending externally from connector near the bottom surface of the housing, a conductive grounding plate mounted on the exterior of the housing, and the grounding plate having at least one grounding terminal disposed in proximity to the high-frequency signal circuit and between the solder tail portions of the terminal.

The tail portions of the terminals and the grounding terminals of the grounding plate are preferably aligned together so that they lie flush in substantially the same horizontal plane and the respective circuit board mounting surfaces thereof are coplanar. The grounding plate may be provided with additional grounding terminals at both ends thereof as well as at along intermediate portions of the grounding plate where the grounding terminals are arranged between a plurality of the connector conductive terminals.

The grounding terminals are formed in the grounding plate by an appropriate method, such as stamping and forming, which avoids the need for providing ground terminals within the conductive terminals of the connector, thereby permitting the present invention with connectors of greater circuit numbers. Also, by forming the grounding terminals in the grounding shield, the grounding terminals may be made to lie in substantially the same plane as the connector circuit terminals to maintain the coplanarity of all of the terminals of the connector, which reduces mounting errors encountered in attaching the connector to a printed circuit board.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DESCRIPTION OF THE PREFERRED EMBODIMENT

Figure 1:
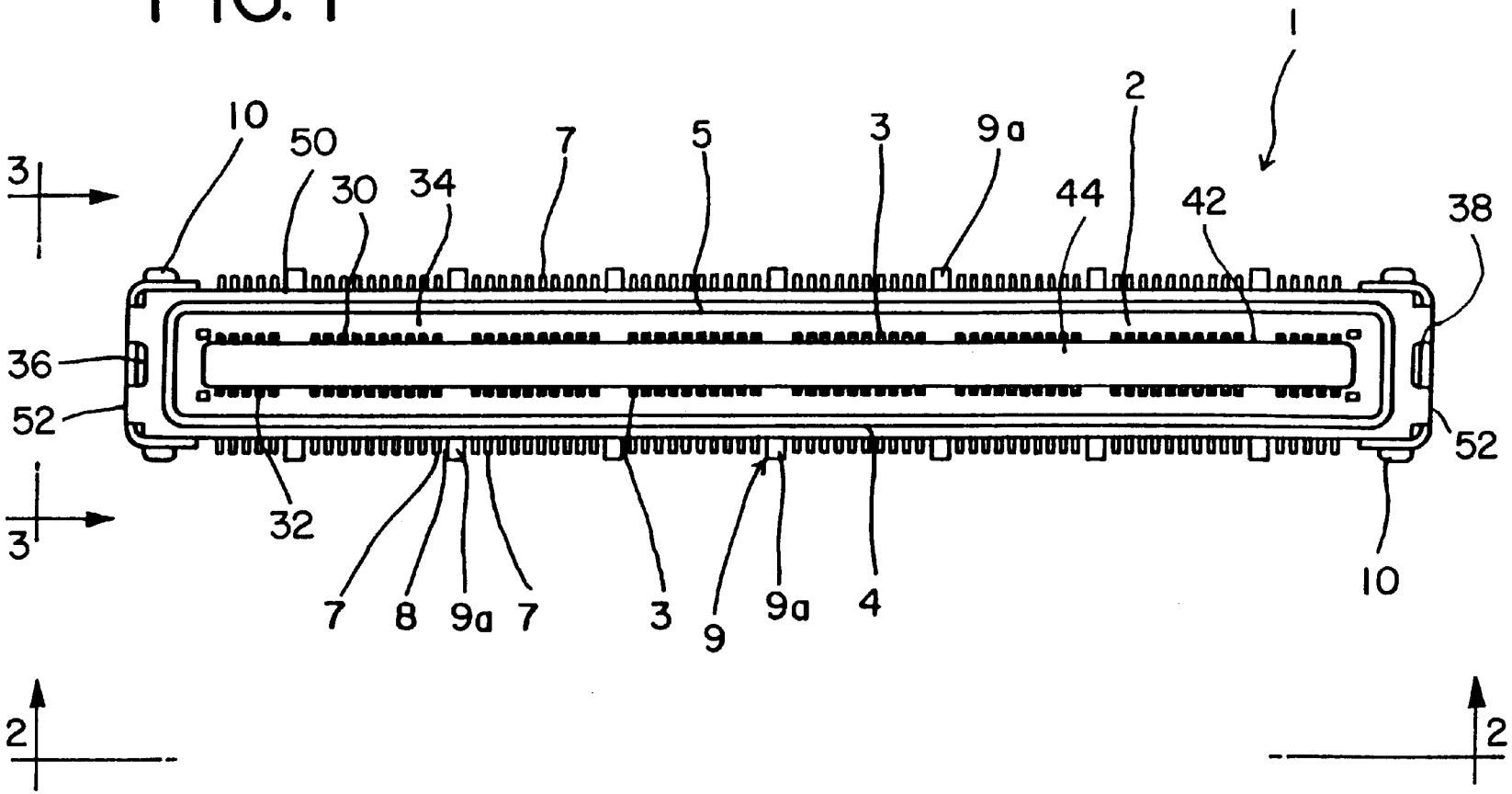
FIG. 1 is a plan view of a receptacle-style electrical connector constructed in accordance with the principles of the present invention.
Figure 2:
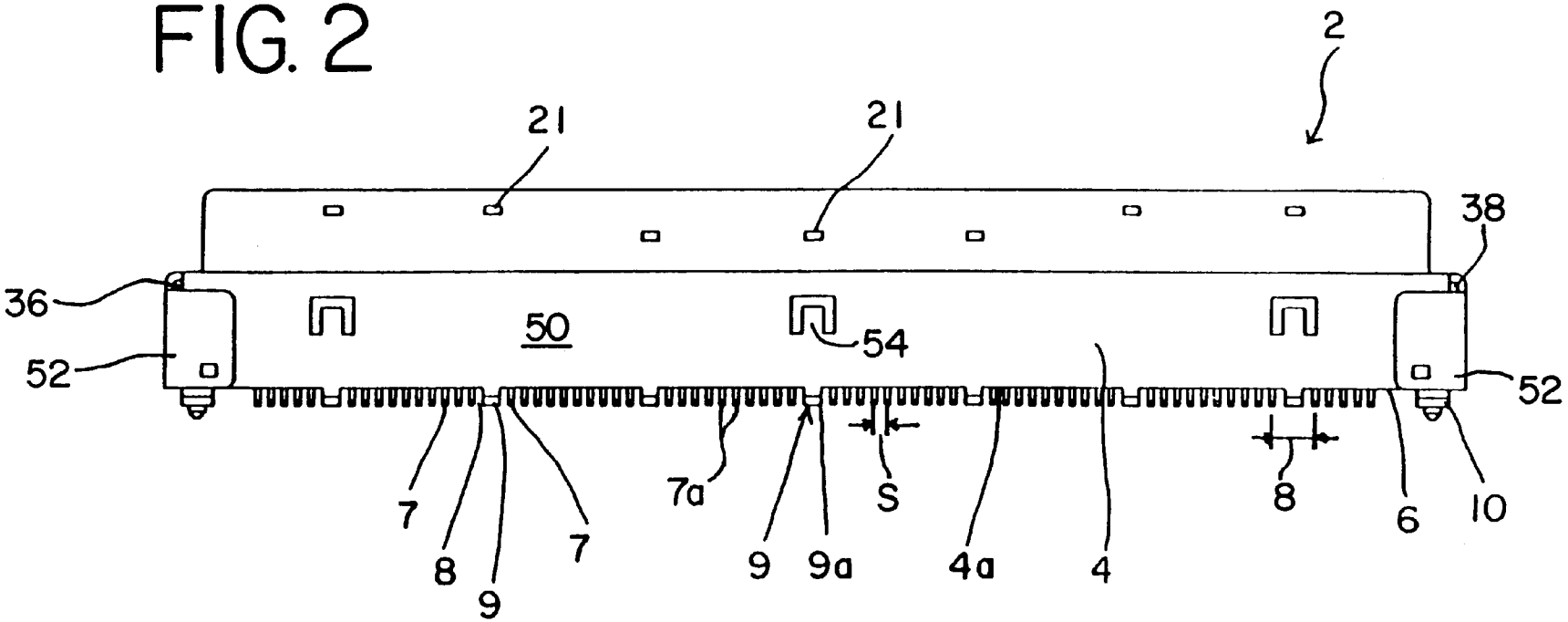
FIG. 2 is a front elevational view of the electrical connector of FIG. 1 taken along lines 2—2 thereof.
Figure 3:
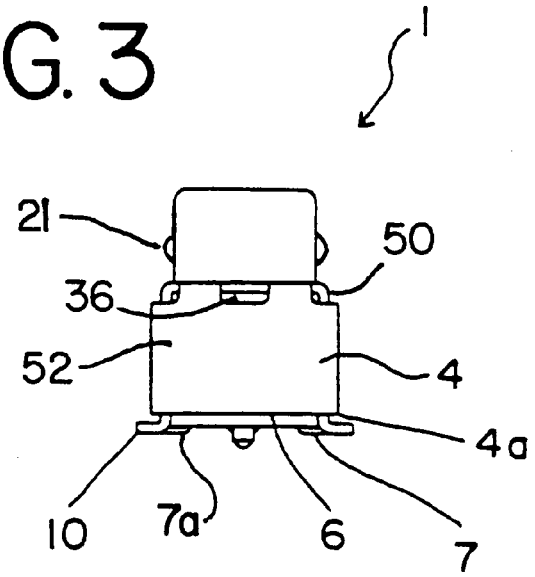
FIG. 3 is an end elevation of the electrical connector of FIG. 1 taken along lines 3—3 thereof.

FIGS. 1 to 3 illustrate a receptacle-style is electrical connector component with enhanced grounding characteristics and constructed in accordance with the present invention, generally indicated at 1. The connector component 1 includes an elongated connector housing 2, preferably formed from an electrically insulative material. A plurality of conductive terminals 3 are disposed within the insulative housing 2 and arranged in two aligned rows 30, 32, preferably parallel within a recess 34 that extends longitudinally with the housing 2 between opposing ends 36, 38 of the connector component 1. The recess 34 is enclosed by a surrounding wall 5 of the connector component. A conductive grounding plate 4, in the form of a shield, is mounted on the exterior of the housing 2 and the shield 4 surrounds the outer periphery of the housing 2.

Figure 7:
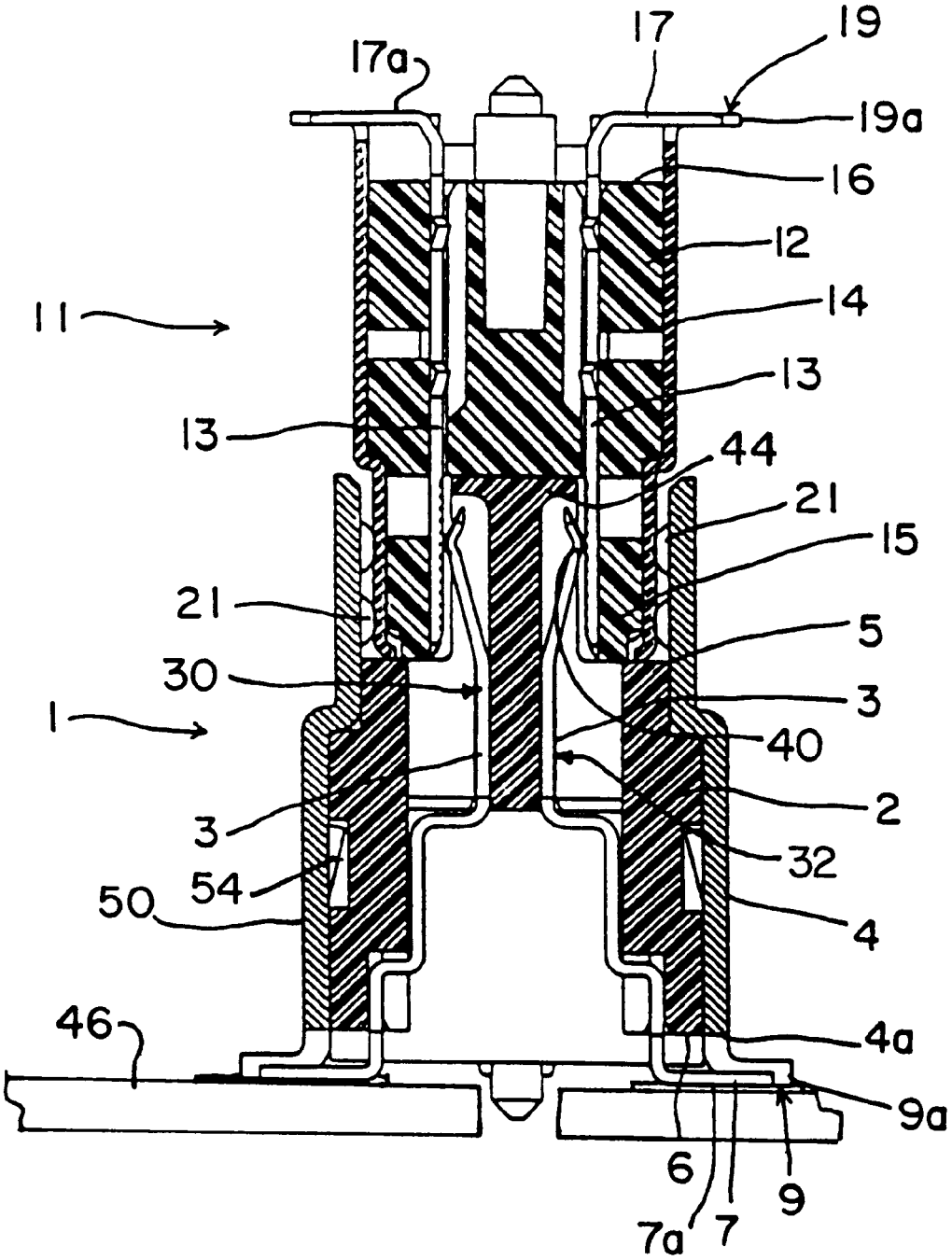
FIG. 7 is an enlarged sectional view of the receptacle and plug-style connectors of FIGS. 1 and 4 engaged together.

The terminals 3 of the connector component 1 can be seen to include engagement or contact portions 40 which lie along interior surfaces of the walls 42 of the pedestal 44 in the recess 34 and which extend further down along the housing sidewalls 5 toward the bottom 6 of the housing 2. (FIG. 7.) Solder tail portions 7 of the terminals are joined to the contact portions 40 and extend outwardly from the connector along the bottom surface 6 in a generally horizontally plane beyond the sides of the housing 2 along the two opposite sides of the connector component 1.

The terminals 3 of each row are maintained in a predetermined spacing "S" at given intervals. Wider spacing intervals 8 are provided between adjoining terminals at particular locations, corresponding in the preferred embodiment depicted, to every Nth terminal. These second spacing intervals 8 separate the conductive terminals 3 of the connector 1 into discrete groups of terminals (and solder tail portions 7). Coincident with these intervals 8, the grounding plate 4 is provided with grounding terminals 9 (FIG. 2) formed along its lower edge 4*a* at the level of the conductive terminal solder tail portions 7. These grounding terminals 9 have general L-shaped configurations and take the form of horizontal lugs which are interposed between the groups of conductive terminals in the wider spacing intervals 8. Each such grounding terminal 9 or lug, also includes a circuit board engagement portion 9*a*, preferably planar in configuration, that extends outwardly and lies in a common plane with the solder tail portions 7 of the connector conductive terminals 3. Thus, the bottom surfaces of the conductive terminal solder tail portions 7 and the grounding terminals 9 will preferably be coplanar so that the connector may be mounted on an associated printed circuit board 46 by conventional surface soldering.

The connector component grounding shield 4 may also include secondary grounding terminals 10 of a greater width than the grounding terminals 9 so that these terminals 10 assist in firmly mounting the connector component 1 to the printed circuit board by soldering. The grounding shield 4 is preferably stamped and formed from sheet metal stock to define, as illustrated in the preferred embodiment of FIGS. 1–7, two opposing, substantially planar body portions 50 with retention flanges 52 disposed at their opposite ends that are folded down and over into a firm holding engagement with the connector component housing 2. The body portions 50 may include a series of engagement tabs 54 formed therein which extend slightly inwardly into frictional engagement with the connector component housing 2.

Figure 6:
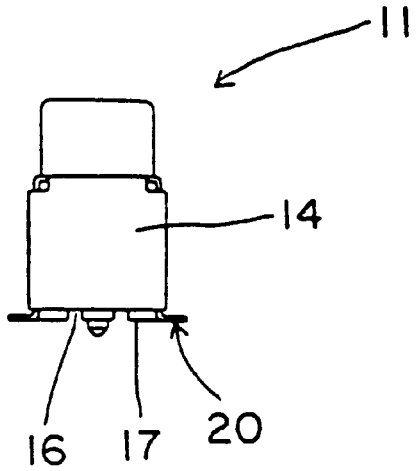
FIG. 6 is a side elevational view of the connector of FIG. 4 taken along lines 6—6 thereof.
Figure 4:
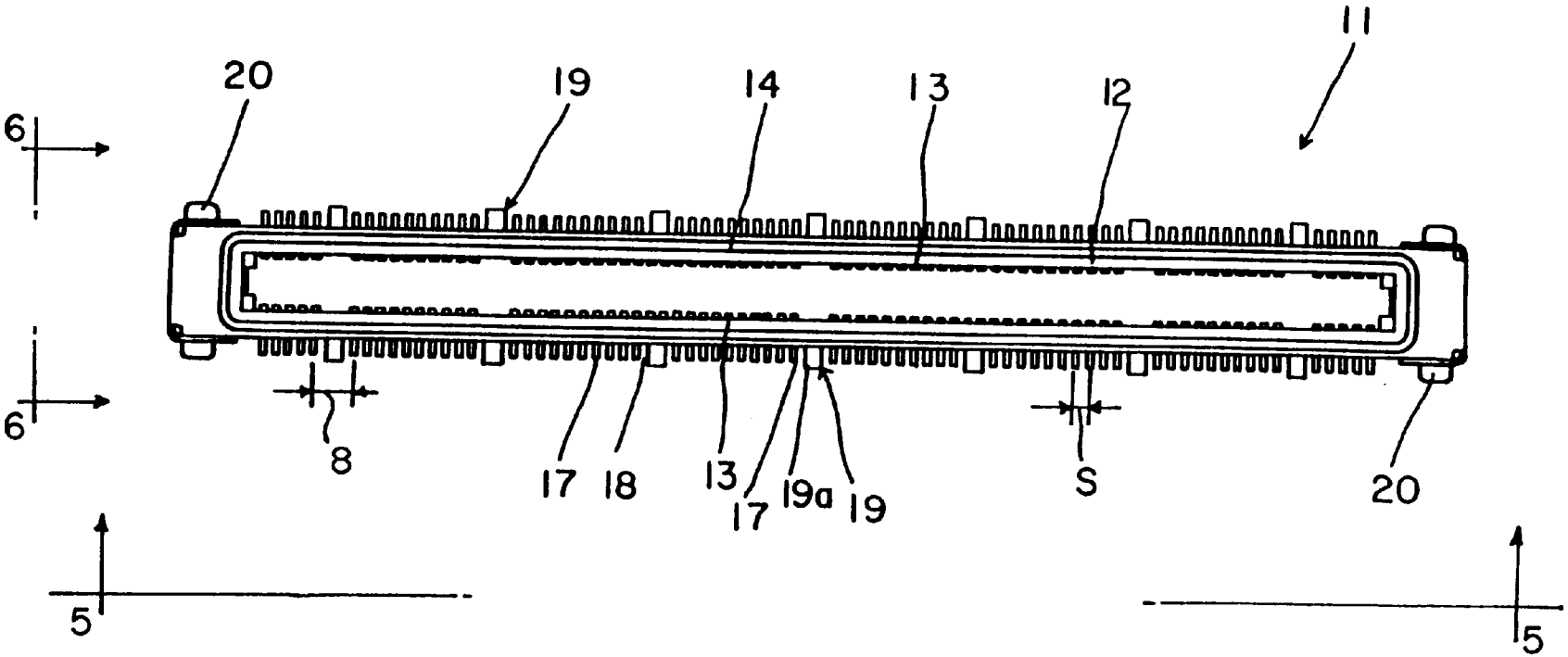
FIG. 4 is a plan view of a plug-style electrical connector with enhanced grounding characteristics constructed in accordance with the principles of the present invention.
Figure 5:
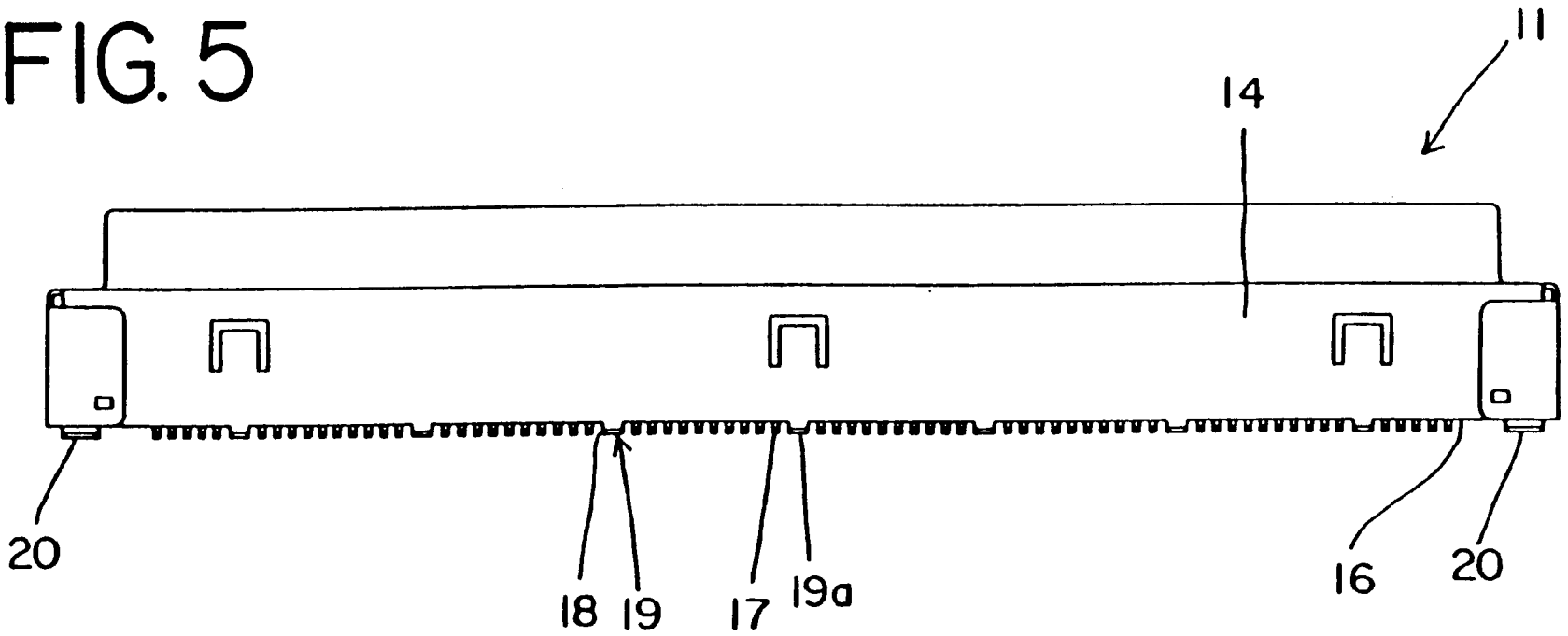
FIG. 5 is a frontal elevational view of the connector of FIG. 4 taken along lines 5—5 thereof.

FIGS. 4 to 6 illustrate a preferred embodiment of a plug-style electrical connector 11 with enhanced grounding characteristics which is engageable with the receptacle connector 1 described above. Similar to connector component 1, the plug-style connector 11 includes an elongated connector housing 12 formed from an insulative material and a plurality of terminals 13 disposed thereon with solder tail portions 17 extending from the bottom 16 of the connector component 11. It further includes an exterior conductive grounding plate 14 in the form of a metallic grounding shield. The terminals 13 are aligned in two separate rows along the longitudinal extent of the housing 12 so as to oppose, and engage, corresponding opposing terminals 3 of the receptacle-style connector component 1. The terminals 13 in each row are spaced apart from each other at a first predetermined spacing "S" and include second predetermined spacings or intervals 18, which are wider than the first spacing. The grounding plate 14 is provided with a plurality of grounding terminals 19 corresponding in number to the number of second spacing intervals and which are disposed at locations thereon corresponding to these wider spacing intervals 18.

These grounding terminals 19 extend in these wide intervals 18 and are also preferably positioned in both the horizontal and vertical directions so that their bottom planar engagement surfaces 19*a* will lie in the same horizontal plane as the planar engagement surfaces 17*a* of the connector component conductive terminals 13 in order to maintain coplanarity of both the grounding and conductive terminals of the connector component as well as alignment with opposing contact pads of grounding circuits of an associated circuit board. On opposite ends of this connector component 11, grounding terminals 20 which are larger than the grounding terminals 19 are provided for the purpose explained above.

FIG. 7 is a sectional view of a receptacle-type connector component 1 and a plug-type connector component 11 interengaged together. In this engagement, the terminals 3 and 13 of the two connector components 3, 13 contact each other in an electrically conductive fashion. The grounding plate 14 of the plug-type connector 11 engages the inside of the ground plate 4 of the receptacle-type connector component 1 at the engagement end 15 thereof. A conductive engagement projection 21 which is formed inside of the grounding plate 4 engages the grounding plate 14 so that the two grounding plates 4 and 14 are connected electrically together.

In the illustrated embodiment, when high frequency voltage is applied to any one of the terminals 3 and 13, the high frequency current that jumps or which is induced alongside the connector components 1, 11 by way of capacitive coupling in the exterior grounding plates 4, 14 will flow toward the closest groundpath. The nearest groundpaths are provided by the grounding terminals 9, 19 integrally formed and can be fed to the grounding circuits of the circuit board(s) 46 through the grounding terminals 9 and 19. Accordingly, the distance which the high frequency current signals that are locally formed in the grounding plates 4, 14 is made as short as possible. When a specific number N of grounding terminals 9, 19 is used and the grounding terminals 9, 19 are spaced at equal intervals along the length of the connector 1, 11, this distance to ground for a signal is no greater than 1/N+1 times the length of the connector 1, 11. Therefore, the likelihood of an antenna effect occurring for the conductive terminals 3, 13 is substantially reduced, in not virtually eliminated. As a result, erroneous signal transmission to other terminals 3 and 13 is likewise substantially reduced, which increases the reliability of the ground-enhanced connectors 1 and 11 of the present invention.

It will be understood that position and number of the grounding terminals 9 and 19 provided in each grounding plates 4, 14 is not restricted to that shown in the preferred embodiment illustrated. Since the antenna effect can be avoided by providing grounding terminals 9 and 18 in the vicinity of the connector conductive terminals 3, 13, to which the high frequency current is applied, when number of the terminals 3, 13, which are to be applied the high frequency current is few, the number of grounding terminals 9, 19 may be few, as well.

By arranging at least one of the grounding terminals 9, 19 to be located between any conductive terminals 3, 13, which carry high-frequency signals, the formation of the antenna effect can be avoided. On the other hand, when number of the terminals 3, 13 to which high-frequency current is applied is large, the number of grounding terminals 9, 19 can be increased accordingly from that shown in the preferred embodiment.

Although the solder tail portions 7, 17 and grounding terminals 9, 19 shown in the preferred embodiment extend parallel to the bottom surfaces 6, 16 of the connector housings 2, 12 for surface soldering, it will be understood that the solder tail portions 7, 17 and the grounding terminals 9, 19 may extend from the housing perpendicular to the bottom surfaces 6, 16 thereof so as to enable dip soldering by inserting into the terminals through holes formed in the printed circuit board.

As set forth above, with the grounding enhanced electrical connector of the present invention, the high frequency current induced in the metallic grounding plate can be fed to the grounding circuit through a short path for enhancing the grounding function of the metallic grounding plate. Therefore, erroneous signals will never be transmitted to improve reliability of the electrical connector. And further, because the grounding terminals are directly connected to contact pads on the printed circuit board, the need to connect the grounding terminals to specific conductive terminals of the connector, either interior or exterior of the connector housing, is eliminated, thereby decreasing the cost of manufacture of the connector.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

We claim:

1. In an electrical connector having an elongated housing with at least one housing wall formed from an electrically insulative material and a plurality of electrically conductive terminals mounted on the connector housing, the conductive terminals having solder tail portions extending out of and away from said connector housing along an extent of said housing wall, said solder tail portions being spaced apart from each other in a first predetermined spacing, said connector further having an electrically conductive grounding plate mounted on outside of said connector housing and extending along said housing wall extent, the improvement, comprising:

at least one primary grounding terminal integrally formed in said grounding plate at the level of said conductive terminal solder tail portions, and said conductive terminal solder tail portions being arranged in at least two discrete groups spaced apart from each other in a second predetermined spacing to define a grounding space that separates said two discrete groups of conductive terminal solder tail portions, the grounding space receiving said primary grounding terminal therein.

2. A connector as set forth in claim 1, wherein said conductive terminal solder tail portions and said primary grounding terminal lie in substantially the same plane.

3. A connector as set forth in claim 1, wherein said grounding plate includes secondary grounding terminals at opposite ends of said connector housing, said primary grounding terminal being disposed on said grounding plate intermediate said secondary grounding terminals.

4. A connector as set forth in claim 1, wherein said grounding plate includes a plurality of primary grounding terminals integrally formed in said grounding plate at the level of said conductive terminal solder tail portions, said conductive terminal solder tail portions including a like plurality of grounding spaces, each of which receives a single primary grounding terminal therein.

5. A connector as set forth in claim 2, wherein each of said conductive terminal solder tail portions and said primary grounding terminals have respective planar circuit board engagement surfaces, said respective circuit board engagement surfaces lying in a substantially common horizontal plane.

6. A connector as set forth in claim 1, wherein said grounding plate includes means for frictionally engaging exterior surfaces of said connector housing.

7. A connector as set forth in claim 6, wherein said frictional engagement means includes at least one engagement tab formed in a body portion of said grounding plate.

8. A connector as set forth in claim 4, wherein said primary grounding terminals are spaced along the length of said connector at equal intervals.

9. A connector as set forth in claim 4, wherein said connector includes N primary grounding terminals spaced longitudinally in equal intervals along said grounding plate to define N groundpaths, whereby the shortest distance which any signal carried by said connector conductive terminals has to travel to reach one of said groundpaths by way of capacitive coupling through said connector housing is no greater than 1/N+1 times the length of said connector.

10. A connector as set forth in claim 1, wherein said grounding plate is formed from a sheet metal blank having two parallel longitudinal side portions and two transverse end portions, the transverse end portions being folded into contact with said side portions to define a hollow enclosure which receives said connector housing therein.

11. A connector as set forth in claim 10, wherein said grounding plate side and end portions are integrally formed together in a single sheet metal blank.

12. A connector with enhanced grounding characteristics, the connector comprising an elongated housing formed from an electrically insulative material, the connector housing having an interior portion containing a plurality of electrically conductive terminals, the conductive terminals each having a contact portion disposed within said connector housing interior portion and a solder tail portion extending out of and away from said connector housing at a level for engagement with a printed circuit board, said conductive terminal solder tails portions further being disposed along a length of said connector in discrete sets by intervening spaces, said connector further including an electrically conductive grounding plate disposed on said connector housing such that portions of said connector housing lie between said grounding plate and said conductive terminals, said grounding plate including a plurality of grounding terminals formed therein and extending away from said connector housing at said circuit board engagement level and interposed between selected pairs of said discrete sets of said conductive terminals, said grounding terminals extending into said intervening spaces thereby defining a plurality of groundpaths for signals coupled from said conductive terminals to said grounding plate.

13. The connector of claim 12, wherein said grounding plate includes a metal grounding shield, the grounding shield including means for frictionally engaging an exterior surface of said connector housing.

14. The connector of claim 12, wherein said conductive terminal solder tail portions are disposed in a series of preselected groups along the length of said connector at a first predetermined spacing and said groups of conductive terminals solder tail portions are spaced apart from each other by a second predetermined spacing which is greater than said first predetermined spacing, said grounding terminals being received within said second predetermined spacing and being interposed between two adjacent groups of said conductive terminals.

15. The connector of claim 12, wherein each of said grounding terminals extends away from said connector housing in a common plane with said conductive terminal solder tail portions.

16. The connector of claim 12, wherein said grounding plate includes a plurality of engagement tabs adapted to frictionally engage exterior surfaces of said connector housing.

17. The connector of claim 12, wherein said connector housing interior portion includes an elongated recess and said conductive terminals are disposed along two opposing sides of said recess.

18. The connector of claim 12, wherein said grounding terminals are integrally formed in said grounding plate at substantially the same level at which said conductive terminal solder tail portions extend out of said connector housing.

19. The connector of claim 12, wherein said connector interior portion is enclosed by a plurality of connector housing walls and said grounding plate includes a hollow enclosure which overlies said connector housing walls.

20. An electrical connector comprising: an elongated connector housing formed from an electrically insulative material, the connector having a plurality of electrically conductive terminals disposed therein, said connector housing having a plurality of walls which define exterior surfaces of said connector and which define an interior recess of said connector, said conductive terminals having contact portions disposed within said recess and circuit board attachment portions which extend away from said connector exterior surfaces, said connector further including an electrically conductive grounding shield which overlies at least one exterior surface of said connector in opposition to a group of said conductive terminals such that said conductive grounding shield and said group of conductive terminals are separated by one of said connector housing walls, said conductive terminal attachment portions being segregated into discrete arrays along the length of said connector by intervening grounding spaces, said grounding shield including a plurality of grounding terminals formed integrally therewith and extending outwardly therefrom away from said connector housing exterior surfaces, said grounding terminals being received within said grounding spaces and interposed between adjacent arrays of said conductive terminal attachment portions.

21. The connector of claim 20, wherein said conductive terminal attachment portions and said grounding terminals each include circuit board attachment faces which are substantially disposed in a common plane.

22. The connector of claim 20, wherein said grounding shield includes two longitudinal body portions and two transverse end portions which cooperate to define a hollow shielding enclosure which overlies said connector housing exterior surfaces.

23. A connector with enhanced grounding characteristics, the connector comprising an elongated housing formed from an electrically insulative material, the connector housing having an interior portion containing a plurality of electrically conductive terminals, the conductive terminals each having a contact portion disposed within said connector housing interior portion and a solder tail portion extending out of and away from said connector housing at a level for engagement with a printed circuit board, said connector further including an electrically conductive grounding plate disposed on said connector housing such that portions of said connector housing lie between said grounding plate and said conductive terminals, said grounding plate including a plurality of grounding terminals formed therein and extending away from said connector housing at said circuit board engagement level and interposed between selected pairs of conductive terminals, said grounding terminals defining a plurality of groundpaths for signals coupled from said conductive terminals to said grounding plate, said conductive terminal solder tail portions being disposed in a series of groups along the length of said connector at a first predetermined spacing, said groups of conductive terminals solder tail portions being spaced apart from each other by a second predetermined spacing which is greater than said first predetermined spacing, said grounding terminals being received within said second predetermined spacing and being interposed between two adjacent groups of said conductive terminals.

24. An electrical connector comprising: an elongated connector housing formed from an electrically insulative material, the connector having a plurality of electrically conductive terminals disposed therein, said connector housing having a plurality of walls which define exterior surfaces of said connector and which define an interior recess of said connector, said conductive terminals having contact portions disposed within said recess and circuit board attachment portions which extend away from said connector exterior surfaces, said connector further including an electrically conductive grounding shield which overlies at least one exterior surface of said connector in opposition to a group of said conductive terminals such that said conductive grounding shield and said group of conductive terminals are separated by one of said connector housing walls, said conductive terminal attachment portions being segregated into discrete arrays along the length of one of said walls of said connector by intervening grounding spaces, said grounding shield including a plurality of grounding terminals formed integrally therewith and extending outwardly therefrom away from said connector housing exterior surfaces, said grounding terminals being received within said grounding spaces and interposed between adjacent arrays of said conductive terminal attachment portions.

* * * * *